US006475419B1

(12) United States Patent
Lagarden et al.

(10) Patent No.: US 6,475,419 B1
(45) Date of Patent: Nov. 5, 2002

(54) AUXILIARY AGENT FOR THE PRODUCTION OF CELLULOSE FIBERS

(75) Inventors: Martin Lagarden; Raymond Mathis; Ursula Kolken, all of Duesseldorf (DE)

(73) Assignee: Cognis Deutschland GmbH, Duesseldorf (DE)

( * ) Notice: Subject to any disclaimer, the term of this patent is extended or adjusted under 35 U.S.C. 154(b) by 0 days.

(21) Appl. No.: 09/581,031

(22) PCT Filed: Nov. 28, 1998

(86) PCT No.: PCT/EP98/07700

§ 371 (c)(1),
(2), (4) Date: Sep. 6, 2000

(87) PCT Pub. No.: WO99/29937

PCT Pub. Date: Jun. 17, 1999

(30) Foreign Application Priority Data

Dec. 8, 1997 (DE) ..... 197 54 314

(51) Int. Cl.[7] ..... C07C 291/04; C08B 9/00; C08L 1/24; D01D 5/06; D01F 2/10

(52) U.S. Cl. ..... 264/170; 106/166.42; 264/189; 264/193; 264/194; 536/60; 564/297

(58) Field of Search ..... 264/170, 189, 264/193, 194; 106/166.42; 536/60; 564/297

(56) References Cited

U.S. PATENT DOCUMENTS

| | | | |
|---|---|---|---|
| 3,364,290 | A | 1/1968 | Anetma et al. |
| 3,381,075 | A | 4/1968 | Tonami et al. |
| 3,891,709 | A | 6/1975 | Higuchi et al. |
| 4,719,044 | A | 1/1988 | Piorr et al. |

FOREIGN PATENT DOCUMENTS

| | | | |
|---|---|---|---|
| DE | 1 023 559 | B | 1/1958 |
| DE | 1 052 054 | B | 3/1959 |
| DE | 1 132 684 | B | 7/1962 |
| DE | 1 163 489 | B | 2/1964 |
| DE | 1 257 354 | B | 12/1967 |
| DE | 1 494 745 | A | 12/1969 |
| DE | 1 494 698 | A | 12/1970 |
| DE | 23 32 277 | A | 1/1974 |
| DE | 28 37 766 | A | 3/1979 |
| DE | 29 21 314 | A | 12/1979 |
| EP | 0 248 197 | A | 12/1987 |
| GB | 930929 | A | 7/1963 |
| GB | 2 004 894 | A | 4/1979 |

OTHER PUBLICATIONS

Z.A. Rogowin, Chemiefasern, Georg Thiemes Verlag, Stuttgart, (1982), pp. 67–152.

W Stein, Fette, Seifen, Antrichmittel, No. 2, Vol. 84 (1992), pp. 45–54.

*Primary Examiner*—Leo B. Tentoni
(74) *Attorney, Agent, or Firm*—John E. Drach; Aaron R. Ettelman

(57) ABSTRACT

Methods of preparing cellulose materials, which methods comprise (a) reacting a cellulosic material with a first basic component to form alkli cellulose; (b) reacting the alkali cellulose with carbon disulfide and a second basic component to form a cellulose xanthate solution; and (c) extruding the cellulose xanthate into an aqueous coagulation bath; wherein a reaction product of an epoxide of the general formula (I):

(I)

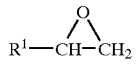

wherein $R^1$ represents a linear or branched aliphatic alkyl group having from about 1 to about 22 carbon atoms, and an amine compound of the general formula (II):

(II)

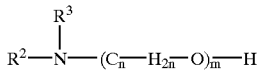

wherein $R^2$ and $R^3$ each independently represent a substituent selected from the group consisting of $—C_nH_{2n}—O)_m—H$, alkyl groups having from about 1 to about 22 carbon atoms, and hydrogen, wherein n represents 2 or 3 and m represents a number of from about 1 to about 20; is present in at least one of the cellulose xanthate solution and the aqueous coagulation bath, are described. Cellulose xanthate solutions and aqueous coagulation baths containing such reaction products are also described.

20 Claims, No Drawings

AUXILIARY AGENT FOR THE PRODUCTION OF CELLULOSE FIBERS

BACKGROUND OF THE INVENTION

The present invention relates to the use of end group capped alkoxylated amines as auxiliary agent in the production of cellulose fibers according to the viscose method and to a method for producing cellulose fibers according to the viscose method.

The viscose method is the predominant method for producing cellulose fibers on an industrial scale. It comprises converting pulp into cellulose xanthate, known as viscose, and extruding it into an acidic coagulation bath. Contact with the acidic solution coagulates the xanthate and saponification releases the cellulose in the form of a filament.

It has been determined that the addition of auxiliary agents, known as modifiers, to the viscose or to the spinning solution can significantly improve the mechanical quality of the fibers spun. The modifiers retard the xanthate decomposition and thereby make possible the formation of a uniform fiber structure (cf. Z.A. Rogowin, Chemiefasern, Georg Thieme Verlag, Stuttgart, 1982, pages 123 ff).

Various classes of substances are known for use as modifiers, for example quaternary ammonium bases, N-substituted dithiocarboxylic acids, polyethylene glycols and also aliphatic monoamines and especially ethoxylated amines and amides or derivatives thereof. DE 28 37 766, for example, describes alkoxylation products of a polyhydric alcohol and/or of a dibasic amine as modifiers. DE 29 21 314 describes a method for producing crimped cellulose fibers using modifiers including, inter alia, ethoxylated fatty acid amines of 8 to 20 carbon atoms. Furthermore, alkylamine glycol ethers are frequently used as modifiers in viscose production. These compounds are prepared by reacting alkoxylated amines with alkyl halides, preferably alkyl chlorides, in the manner of Williamson's ether synthesis. But this method inevitably releases appreciable amounts of salts, the disposal of which is costly and creates environmental problems. In some instances, moreover, residues of the alkyl chlorides remain in the reaction product and may have to be removed in an inconvenient and costly purification.

There is therefore a need for modifying agents which have similar or better properties than the prior art compounds and which can be prepared according to simple and less environmentally adverse methods. More particularly, it should be possible to dispense with the use of chlorine chemicals entirely.

BRIEF SUMMARY OF THE INVENTION

It has been found that certain end group capped nonionic surfactants based on alkoxylated amines have the above-mentioned properties.

The present invention includes the use of end group capped alkoxylated amines as auxiliary agents (i.e., modifiers) in the production of cellulose materials (e.g., fibers and sheets), particularly according to the viscose method. The present invention includes cellulose xanthate solutions and coagulation baths used in accordance with such processes containing such auxiliary agents.

The present invention provides in a first embodiment for the use of reaction products of the nucleophilic ring opening of epoxides of the formula (I)

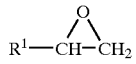

(I)

where $R^1$ is linear or branched aliphatic alkyl of 1 to 22 carbon atoms, with compounds of the formula (II)

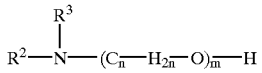

(II)

where $R^2$ and $R^3$ are independently $(C_nH_{2n}—O)_m—H$ or linear or branched saturated or unsaturated alkyl of 1 to 22 carbon atoms or hydrogen, n is 2 or 3 and m is between 1 and 20, as auxiliary agent for the production of cellulose fibers by the viscose method.

DETAILED DESCRIPTION OF THE INVENTION

The ring opening products are known compounds which can be synthesized according to the customary methods of organic chemistry. The synthesis of such compounds generally takes the form of reacting the epoxides of the formula (I) with compounds of the formula (II) in the presence of suitable, preferably alkaline, catalysts, e.g., potassium hydroxide or lithium hydroxide. The use of potassium hydroxide is preferred. A nucleophilic attack of the oxygen atom of the compounds of the formula (II) on one of the epoxide carbon atoms opens the ring to form an α-hydroxy ether. Details relating to this reaction are found for example in the paper by W. Stein in Fette, Seifen, Anstrichmittel, No. 2, volume 84, 1992, page 51 and the references cited therein.

The ring opening reaction is preferably carried out under anhydrous conditions at atmospheric pressure. Depending on the type of reactants used, the reaction temperatures required are between 100 and 180° C. It is preferable in this connection for the reaction to be carried out in the temperature range from 140 to 160° C.

The epoxides of the formula (I) are known compounds which are prepared by epoxidation of alpha-olefins, which are obtained by the Shop process, for example. Typical examples are the epoxides of 1-octene, 1-decene, 1-dodecene, 1-tetradecene, 1-octadecene and 9-octadecene. Preference is given to epoxides of the formula (I) where $R^1$ is linear aliphatic alkyl of 8 to 14 carbon atoms.

The compounds of the formula (II) are known as well. They are ethanolamines or propanolamines and alkoxylation products thereof. These may be obtained for example by alkoxylating mono-, di- or trialkanolamines according to customary methods. Useful alkoxides are ethylene oxide (EO) or propylene oxide (PO) or mixtures thereof. Preference is given to those compounds of the formula (II) where m is between 10 and 20, preferably 12 to 18. Particular preference is given to those compounds which contain ethylene oxide groups only. Preference is given to using those ring opening products which are prepared using ethoxylated or unethoxylated trialkanolamines, preferably triethanolamine. Further suitable compounds are obtainable by alkoxylating other alkanolamines, eg 2-(dibutylamino) ethanol, 2-(diethylamino)ethanol, 2-(methylamino)ethanol, 2-ethylaminoethanol, 2-dimethylaminoethanol, ethanolamine or diethanolamine.

The molar ratio between the epoxide (I) and the compound of the formula (II) in the ring opening reaction is preferably between 1:2 and 1:1. The ring opening products typically have hydroxide numbers of at least 160, preferably of at least 180.

The ring opening products are prepared without addition of chlorine chemicals. Nor does the ring opening reaction, unlike Williamson's ether synthesis, say, by-produce a salt.

The products obtained by ring opening may be added as modifiers not only to the viscose solution but also to the acidic coagulation bath into which the viscose is extruded. The ring opening products are preferably added in amounts between 1 and 5% by weight, based on the cellulose in the viscose or in the coagulation bath.

The use of the ring opening products as modifiers in the viscose solution facilitates the spinning process and is also observed to lead to reduced cloggage of the spinnerets. The use of the ring opening products as modifiers in the acidic coagulation bath is observed to produce a more uniform decomposition of the xanthate cellulose and to retard the fiber formation process. This leads to stronger fiber. At the same time, the precipitation of inorganic salts is prevented.

The modifiers of the invention are useful in all conventional processes for producing cellulose fibers according to the viscose method.

From a further aspect, the present invention provides a method for producing cellulose fibers according to the viscose method, comprising the steps of a) forming alkali cellulose by reacting pulp with alkali metal hydroxide solution b) reacting the alkali cellulose with carbon disulfide and a lye to form a xanthate solution and c) spinning the xanthate solution through spinnerets into an aqueous coagulation bath containing a protic acid and metal salts to decompose the xanthate and form a cellulose threadline, wherein the above-described reaction products are added to the xanthate solution and/or the coagulation bath in effective amounts as modifiers.

As used herein, viscose method refers to the industrially employed cellulose fiber production process as described for example in Z.A. Rogowin, Chemiefasern, Georg Thieme Verlag, Stuttgart, 1982, pages 67 to 152.

In the practice of the method according to the invention, step a) comprises reacting cellulose, for example in the form of pressed sheets, roll material, flakes or expressed undried pulp, with a lye, initially to form alkali cellulose in known manner. The lyes used may be any desired basic systems, especially aqueous alkali metal hydroxide solutions, such as potassium hydroxide solution or sodium hydroxide solution. The concentration is customarily 15 to 30% by weight of base, based on the total weight of the lye.

Squeezing off the excess lye leaves the alkali cellulose. There follows step b), which comprises the individual steps of steeping, xanthation with carbon disulfide, dissolving the xanthate in alkali metal hydroxide solution, ripening and venting and leads to the spinnable viscose solution. Details of this process are described for example in the abovementioned publication by Z.A. Rogowin, pages 97 to 119.

In the method of the invention, the above-described modifiers are added to the xanthate solution during the dissolving of the cellulose xanthate in alkali metal hydroxide solution and/or during the ripening. The amount of modifier is preferably between 1 and 5% by weight, based on the cellulose in the solution.

The ripened xanthate solution is spun in step c) by extruding the solution, after prior filtration and heat-treatment, through a spinneret having essentially round jet holes into the coagulation bath. Examples thereof are spinnerets having 250 to 30,000 holes and a hole individual diameter of 35 to 100 $\mu$m. In the coagulation bath the xanthate coagulates to form fiber and is hydrolyzed by a protic acid to form regenerated cellulose, salt and carbon disulfide. The carbon disulfide is recycled back into the process. Useful protic acids are organic acids such as acetic acid or mineral acids such as hydrochloric, nitric or sulfuric acid. Preference is given to using concentrated sulfuric acid. The coagulation bath, in addition to the acid, also contains certain metal salts capable of retarding the xanthate coagulation. Examples of such salts are magnesium, aluminum, iron and especially zinc salts. The salts are customarily used as chlorides, nitrates or sulfates. The concentration of the salts is generally between 2 to 10 g/l.

In the method of the invention, the coagulation bath has added to it the above-described modifiers, preferably in amounts of 1 to 5% by weight, based on the cellulose contained. The coagulation bath, in addition to the above-described modifiers, the acid and the metal salts, may also include further auxiliary agents known to a person skilled in the art, for example formaldehyde or other modifiers. The cellulose filaments thus obtained are then conventionally spun, purified and further treated.

The method of the invention is notable for modifiers of the above-described type being used at least in one of the two steps b) or c). The method is preferably carried out in such a way that the modifiers are added only to the viscose solution prior to spinning, ie in step b).

EXAMPLE 1226.7 g (1.70 mol) triethanolamine ethoxylate (17 EO) were mixed with 266.6 g (1.36 mol) of α-lauryl epoxide and 12.2 g (0.065 mol) of potassium hydroxide in the form of a 30% by weight methanolic solution and stirred at 160° C. for eight hours under nitrogen. The batch was then cooled down to 80° C. and admixed with 14.9 g (0.15 mol) of $H_2O_2$. After removal of water, the reaction product (1301.5 g) was obtained in the form of a clear brownish orange liquid. Hydroxide number=182, alkali number =0.2, amine number =56, Lovibond color value ($5^{1/4}$ inch): 5 red, 30 yellow.

What is claimed is:

1. A mixture comprising a cellulose xanthate and a reaction product of an epoxide of the general formula (I):

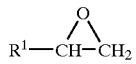

(I)

wherein $R^1$ represents a linear or branched aliphatic alkyl group having from about 1 to about 22 carbon atoms, and an amine compound of the general formula (II):

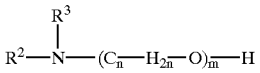

(II)

wherein $R^2$ and $R^3$ each independently represent a substituent selected from the group consisting of $—(C_nH_{2n}—O)_m—H$, alkyl groups having from about 1 to about 22 carbon atoms, and hydrogen, wherein n represents 2 or 3 and m represents a number of from about 1 to about 20.

2. The mixture according to claim, 1, wherein the reaction product is present in an amount of from about 1 to about 5% by weight, based on the amount of cellulose present.

3. The mixture according to claim 1, wherein the cellulose xanthate and the reaction product are present in an aqueous alkali metal hydroxide solution.

4. The mixture according to claim 1, wherein $R^2$ and $R^3$ each represent $—(C_nH_{2n}—O)_m—H$.

5. The mixture according to claim 1, wherein n equals 2.

6. The mixture according to claim 4, wherein n equals 2.

7. The mixture according to claim 1, wherein $R_1$ represents a linear alkyl group having from about 8 to about 14 carbon atoms.

8. The mixture according to claim 1, wherein m represents a number of from about 12 to about 18.

9. The mixture according to claim 1, wherein the reaction product has a hydroxide value of at least about 160.

10. An aqueous coagulation bath comprising water, a protic acid and a reaction product of an epoxide of the general formula (I):

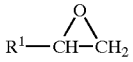

(I)

wherein $R^1$ represents a linear or branched aliphatic alkyl group having from about 1 to about 22 carbon atoms, and an amine compound of the general formula (II):

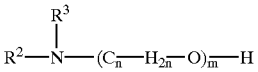

(II)

wherein $R^2$ and $R^3$ each independently represent a substituent selected from the group consisting of $—(C_nH_{2n}—O)_m—H$, alkyl groups having from about 1 to about 22 carbon atoms, and hydrogen, wherein n represents 2 or 3 and m represents a number of from about 1 to about 20.

11. The coagulation bath according to claim 10, further comprising a cellulose xanthate, wherein the reaction product is present in an amount of from about 1 to about 5% by weight, based on the amount of cellulose present.

12. The coagulation bath according to claim 10, wherein $R^2$ and $R^3$ each represent $—(C_nH_{2n}—O)_m—H$.

13. The coagulation bath according to claim 10, wherein n equals 2.

14. The coagulation bath according to claim 12, wherein n equals 2.

15. The coagulation bath according to claim 10, wherein $R^1$ represents a linear alkyl group having from about 8 to about 14 carbon atoms.

16. The coagulation bath according to claim 10, wherein m represents a number of from about 12 to about 18.

17. The coagulation bath according to claim 10, wherein the reaction product has a hydroxide value of at least about 160.

18. A method of preparing a cellulose material, said method comprising:

(a) reacting a cellulosic material with a first basic component to form alkali cellulose;

(b) reacting the alkali cellulose with carbon disulfide and a second basic component to form a cellulose xanthate solution; and (c) extruding the cellulose xanthate into an aqueous coagulation bath; wherein a reaction product of an epoxide of the general formula (I):

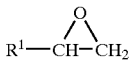

(I)

wherein $R^1$ represents a linear or branched aliphatic alkyl group having from about 1 to about 22 carbon atoms, and an amine compound of the general formula (II):

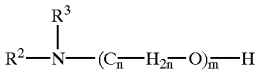

(II)

wherein $R^2$ and $R^3$ each independently represent a substituent selected from the group consisting of $—(C_nH_{2n}—O)_m—H$, alkyl groups having from 1 to about 22 carbon atoms, and hydrogen, wherein n represents 2 or 3 and m represents a number of from about 1 to about 20, is present in at least one of the cellulose xanthate solution and the aqueous coagulation bath.

19. The method according to claim 18, wherein the reaction product is added to the cellulose xanthate solution prior to extruding the cellulose xanthate solution.

20. A method of reducing clogging of extrusion pathways during the formation of cellulose materials, said method comprising combining a cellulose xanthate solution with a reaction product of an epoxide of the general formula (I):

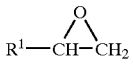

(I)

wherein $R^1$ represents a linear or branched aliphatic alkyl group having from about 1 to about 22 carbon atoms, and an amine compound of the general formula (II):

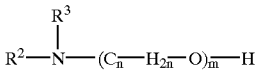

(II)

wherein $R^2$ and $R^3$ each independently represent a substituent selected from the group consisting of $—(C_nH_{2n}—O)_m—H$, alkyl groups having from about 1 to about 22 carbon atoms, and hydrogen, wherein n represents 2 or 3 and m represents a number of from about 1 to about 20; prior to extruding the cellulose xanthate solution into a coagulation bath.

* * * * *